169-45 SR
7/31/84 XR 4,463,346

United States Patent [19]

Bates

[11] Patent Number: 4,463,346

[45] Date of Patent: Jul. 31, 1984

[54] CREOSOTE DETECTOR

[76] Inventor: Gordon Bates, Rte. 1, Box 29B, Nixa, Mo. 65714

[21] Appl. No.: 349,002

[22] Filed: Feb. 16, 1982

[51] Int. Cl.[3] ..... G08B 21/00

[52] U.S. Cl. ..... 340/540; 110/193; 169/45; 324/71.3

[58] Field of Search ..... 340/540; 324/71.3; 169/45, 61, 23; 110/193

[56] References Cited

U.S. PATENT DOCUMENTS 4,378,555 3/1983 Johnson et al. ..... 340/588

*Primary Examiner*—Glen R. Swann, III

*Attorney, Agent, or Firm*—D. A. N. Chase; Michael Yakimo, Jr.

[57] ABSTRACT

A creosote detector for ascertaining a critical amount of creosote buildup on a chimney flue includes a collector probe mounted contiguous to the chimney flue for a buildup of creosote material thereon. An electrical resistance is variously detected corresponding to the deposit level of the creosote across two conductive plates of the collecting probe. A silicon unilateral switch is designed to operably respond to a certain resistance presented thereto causing the silicon unilateral switch to conduct which triggers the alarm circuit including a flag alarm mounted to the exterior of the chimney proper. Thus, the homeowner is warned of a critical creosote buildup within the chimney flue so that preventive maintenance can then be performed.

14 Claims, 4 Drawing Figures

CREOSOTE DETECTOR

BACKGROUND OF THE INVENTION

This invention relates to a detector for ascertaining a buildup of deposit material on selected surfaces and more particularly to a creosote detector for indicating to the homeowner the presence of an undesirable/dangerous amount of creosote buildup within the chimney flue.

Generally, for various energy related and aesthetic reasons the use of the home fireplace has become a burgeoning one. In turn an increased amount of creosote buildup due to combustion of the wood resins in the chimney flue results. This creosote buildup is aggravated by the use of improperly dried and/or soft high resin wood in the fireplace. These factors among others can contribute to a dangerous creosote buildup inside the chimney flue. If such creosote buildup is undetected, combustion of the creosote can ultimately take place within the chimney flue and spread to other parts of the home leading to damaging results.

Heretofore, one response to the problem of creosote buildup is to have regular maintenance performed on the chimney flue e.g., by a chimney sweep. However, this maintenance will vary according to the extent of use of the fireplace and/or the type and/or condition of the wood burned therein. Thus, a regular yearly sweep may be necessary for a moderate fireplace user especially if one is using a properly dried hard wood. On the other hand, if the fireplace usage is a heavy one and/or soft woods are used as the woodburning material, it may be necessary to have a more frequent chimney sweep so as to assure that no potentially dangerous creosote buildup occurs.

Accordingly, it is desirable to have means which would indicate to the home owner the presence of a dangerous amount of creosote buildup so that a chimney sweep can be performed. A means of measuring the creosote buildup within the fireplace and indicating to the homeowner a critical creosote buildup would be advantageous both as to a safety consideration and as an economic one in the utilization of a chimney sweep only when needed. In response thereto I have invented a creosote detector designed to collect and detect the creosote buildup within the chimney flue. At a preselected creosote level an audible or visual signal is presented to the homeowner, either in the form of a visual flag mounted to the outside of the chimney proper or an audible or visual alarm within the home proper. In my now preferred embodiment once the critical creosote level is reached, an alarm circuit is energized causing a flag to spring into a position indicating to the homeowner and/or passing chimney sweep that chimney maintenance should be provided.

It is therefore a general object of this invention to provide apparatus for detecting a buildup of deposit material on a selected surface.

Another general object of this invention is to provide apparatus for ascertaining the amount of creosote buildup within the chimney flue.

Still another object of this invention is to provide apparatus, as aforesaid, having an alarm system for indicating to the homeowner that a predetermined amount of the material/creosote buildup has been reached.

A still further general object of this invention is to provide apparatus, as aforesaid, having a creosote collection device and means therein for detecting the level of said buildup in a manner to trigger the alarm system upon a predetermined creosote buildup thereon.

A more particular object of this invention is to provide apparatus, as aforesaid, having a creosote collection system, as aforesaid, in the manner of a collecting probe positioned in the chimney flue for creosote buildup thereon concurrent with the creosote buildup on the chimney flue.

A further particular object of this invention is to provide a collecting probe, as aforesaid, which provides an output signal corresponding to the amount of creosote buildup to the associated alarm system.

Another object of this invention is to provide an alarm system, as aforesaid, having a circuit operably responsive to a preselected output signal presented thereto by the creosote collection system.

A further object of this invention is to provide a creosote collection system, as aforesaid, which presents a variable output signal to the circuit, said presented signal variously corresponding to the amount of creosote buildup thereon.

A more particular object of this invention is to provide means for functional operation of the creosote detector only when the fireplace is in a woodburning mode.

Other objects and advantages of this invention will become apparent from the following description taken in connection with the accompanying drawings, wherein is set forth by way of illustration and example, and embodiment of this invention.

DESCRIPTION OF THE PREFERRED EMBODIMENT

Figure 2:
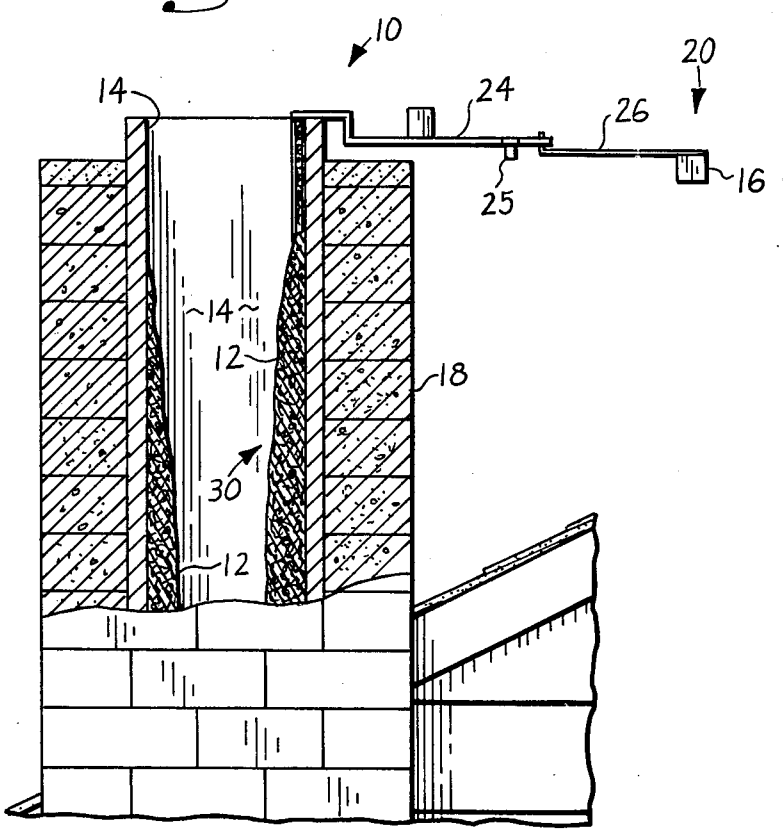
FIG. 2 is the sectional elevation view of FIG. 1, showing a creosote buildup on the chimney flue, with the flag alarm in a warning position indicating the deposit of a predetermined level of creosote buildup on the chimney flue.

The creosote detector system 10 generally comprises an alarm 20, a creosote collector/detector 30 and a trigger device 40 for energizing an alarm circuit 22 (FIG. 3) upon the deposit of a predetermined amount of creosote 12 within the chimney flue 14.

Figure 1:
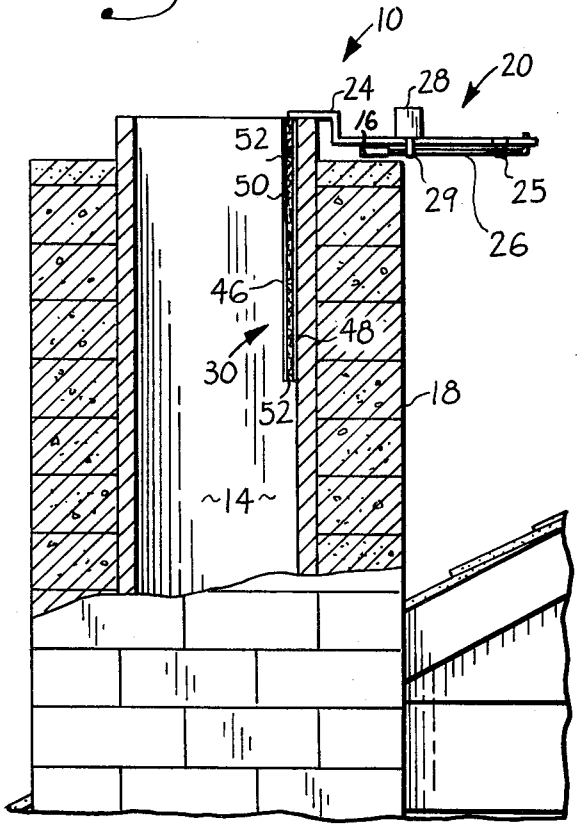
FIG. 1 is a sectional view of the top of a chimney illustrating the creosote detector mounted thereto with the flag alarm in an off position.

The alarm assembly 20 generally comprises a warning flag 16 operable by the alarm circuit 22 in a manner to horizontally swing from a first position as shown in FIG. 1 to a danger-indicative position as shown in FIG. 2. The mechanical components of the alarm assembly 20 are as shown in FIGS. 1 and 2 and generally comprise a chimney mounting plate 24, the flag 16 and a spring 25 biased flag arm 26 pivotally mounted to the mounting plate 24 at one end thereof.

The flag 16 is held in a first position as shown in FIG. 1 by solenoid 28 mounted to the plate 24 in a manner so that the armature 29 of the solenoid 28 vertically extends through plate 24 and across the horizontally extending spring 25 biased arm 26 for preclusion of swinging movement thereto. Energization of the solenoid 28 causes withdrawal of the solenoid armature 29 from this locking position to allow the arm 26 to swing to the warning position shown in FIG. 2.

Figure 3:
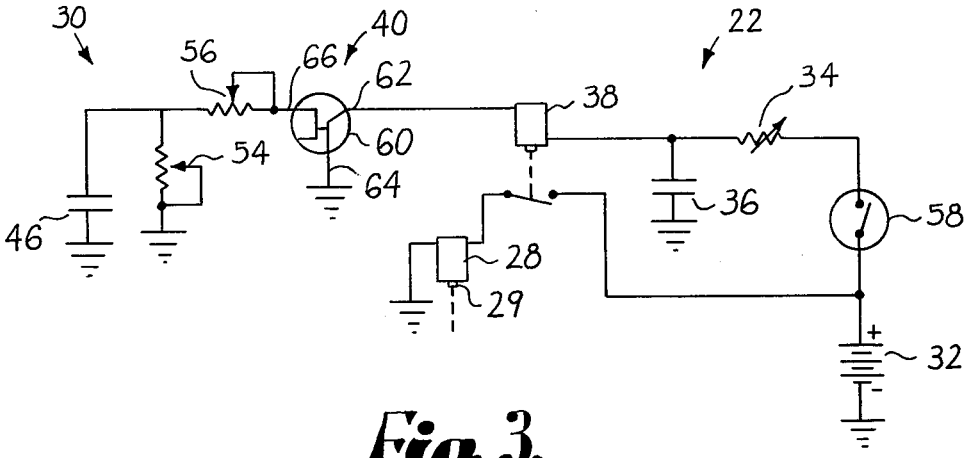
FIG. 3 is a circuit diagram showing the alarm circuit as well as circuitry for detection of the collected creosote buildup and conversion thereto to a signal presented to the associated alarm circuit.

I have designed an alarm circuit 22, as shown in FIG. 3 providing for a controlled flow of current to the solenoid 28 and withdrawal of the armature 29. This alarm circuit 22 generally comprises a pair of series connected nine-volt batteries 32 with a high resistance rheostat 34 (100K ohms) connected thereto. Thus, stored voltage is developed across capacitor 36 (1000 Mfd) which provides upon demand a surge current to operate relay 38. Operation of the relay 38 energizes the solenoid 28 for withdrawal of the armature 29 as above-described.

A trigger device 40 (FIG. 3) is in the form of a silicon unilateral switch 60 purchased from the Sylvania Company under the catalog number ECG 6404. As schematically shown this switch 60 has an anode 62, cathode 64 and a gate 66. Switch 60 is normally in a non-conductive state and is responsive to a predetermined resistance presented to the gate 66 in a manner allowing for a cathode 64 to anode 62 current flow. Thus, switch 60 being in an initial nonconductive state presents an open in the alarm circuit 22. Although there is a small leakage current through switch 60 this current is not sufficient for energization of the relay 38 and solenoid 28.

As stated switch 60 is responsive to a critical resistance presented to the gate 66. Once this breakdown resistance is presented, the switch 60 is triggered into full conduction, allowing a surge current to flow through the alarm system 20 connected thereto.

An assembly 30 (FIGS. 1, 2, 4) for collection and detection of the creosote 12 buildup within flue 14 is provided. This assembly comprises a creosote collector probe 46 having an elongated, metal ground plate 48 and a relatively narrower trigger plate 50 with an insulating adhesive 52 therebetween. A pair of rheostats 54, 56 (100K ohms) are connected in parallel and series with the collecting probe 46 and with the gate 66 of the silicon unilateral switch 60 as shown in the circuitry of FIG. 3.

As shown in FIGS. 1 and 2 the detector 10 is mounted to the chimney 18 by plate 24 with the collector probe 46 downwardly depending in contiguous contact with the chimney flue 14. As the creosote 12 builds up on the chimney flue 14 a similar buildup develops across the plates 48 and 50 of this collecting probe 46. This creosote buildup develops a resistance across the conductive plates 48, 50 of the probe 46 which is presented to gate 66. This developed resistance varies according to the amount of creosote buildup and may be modified by the rheostats 54 and 56 which presents a sensitivity adjustment to the resistance developed on the probe 46. This adjustment allows for the preselection of a level of creosote buildup on the collecting probe 46 as the critical one. Thus, the actual resistance presented by the buildup on probe 46 to switch 60 may be modified so as to present the critical resistance thereto for closure of the switch 60 and operation of the associated alarm 20.

In the physical design of the alarm system 20 as shown in FIGS. 1 and 2 the armature 29 of the solenoid returns to its locking position of FIG. 1 upon deenergization of the solenoid 28. Thus, upon complete discharge of the capacitor 36 the silicon unilateral switch 60 ceases to conduct causing the solenoid armature 29 to return to its locking position. Accordingly, to assure that the solenoid armature 29 subsequently returns to its open position the alarm circuit 22 provides for a recharging of the capacitor 36. Once recharged the switch 60 again conducts and triggers the alarm system 20 connected thereto. This design is effective in periods of ice buildup which would preclude the flag arm 26 from swinging to its danger indicative position of FIG. 2 despite withdrawal of the armature 29 from its locking position. This recharging and retriggering of the alarm circuit 22 is also effective in the employment of other types of alarms such as visual warning lights and/or audible buzzers located within the house proper.

An optional heat sensitive fan switch 58 positioned within flue 14 may be utilized which would close only when the fireplace is in use. This is to preclude a false triggering of the alarm 20 during periods of rain and snow as false resistance may be developed across the collector probe 46 and indicate to the silicon unilateral switch 60 that the critical amount of creosote buildup has been reached. Thus, this heat sensitive switch 58 allows the creosote detector 10 to function only when the fireplace is in use.

Figure 4:
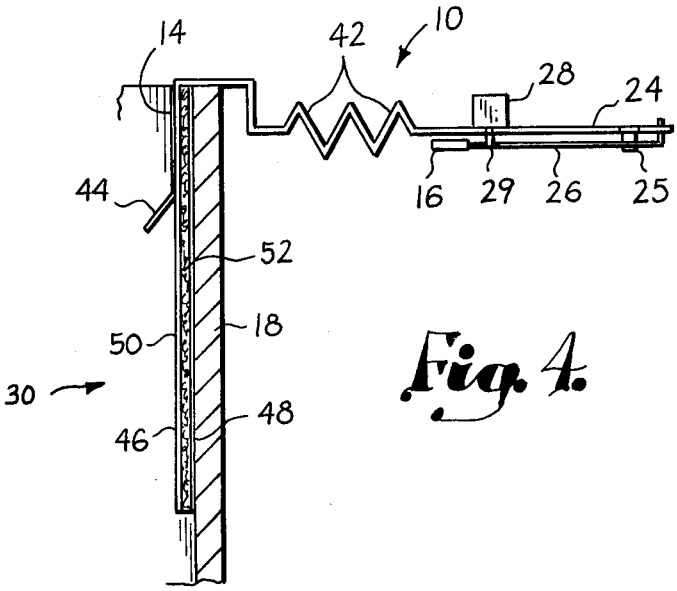
FIG. 4 is a partial sectional elevation view showing the creosote detector equipped with a rain shield and heat dissipating mounting plate thereon.

In certain instances the flue 14 may reach extremely high temperatures which could damage the components of the detector 10. Accordingly, the mounting plate 24 may have a series of sharp vertical bends 42 as shown in FIG. 4 for dissipation of heat therefrom. Also, a shield 44 may be mounted above the collecting probe 46 to ward off foreign elements that may indicate a false resistance across this collecting probe.

Although not shown, the circuit of FIG. 3 is placed in a weatherproof housing suitably located on mounting plate 24. It is preferred that the batteries 32 be suitably displaced from the housing allowing for easy replacement by the homeowner when required. Thus, suitable lead wire should be extended between the circuitry enclosed in the housing and batteries 32.

It is understood that the position of the collector probe 46 within flue 14 and the level of deposit for triggering the alarm circuit 22 are not fixed parameters. Also having disclosed a means of presenting an output signal to the alarm circuit 22 corresponding to a physical creosote deposit it is understood that other forms of circuitry may be utilized.

Accordingly, it is to be understood that while certain forms of this invention have been illustrated and described, it is not limited thereto, except in so far as such limitations are included in the following claims.

Having then discussed the invention, what is claimed as new and desired to be secured by Letters Patent is:

1. A creosote monitoring device comprising:

collection means for receiving a creosote deposit thereon corresponding to a like amount of creosote deposit on a portion of a chimney flue;

detection means for producing an output corresponding to the level of said deposit;

an alarm circuit having an off mode and an on mode indicative of the accrual of a selected level of creosote deposit; and trigger means operably responsive to a selected output corresponding to said selected level of creosote for actuating said alarm circuit into said on mode.

2. The device as claimed in claim 1, wherein said collection means comprises:

a probe member for deposit of said creosote thereon; and mounting means for positioning said probe adjacent said chimney flue in a manner to provide for a concurrent creosote deposit on said probe and on said chimney flue.

3. The device as claimed in claim 2, wherein said probe further comprises:

first and second conductive plates with one of said plates lying contiguous to said chimney flue, said creosote deposit variously bridging said conductive plates according to the level of creosote deposit on said chimney flue.

4. The device as claimed in claim 3, wherein said detection means comprises:

circuitry joining said probe to said trigger means with said creosote deposit on said conductive plates providing an output signal variously corresponding to the amount of said creosote deposit bridging said conductive plates; and said trigger means operably responsive to a selected output signal providing for said actuation of said alarm circuit.

5. The device as claimed in claim 4, wherein said trigger means includes a switch presenting a normal open to said alarm circuit, said trigger means closing said switch in response to said selected output signal to close said alarm circuit providing for said alarm circuit actuation.

6. The device as claimed in claim 5, wherein said trigger means is a silicon unilateral switch having a cathode and anode for current flow therebetween and a gate for receiving said output signal, said gate operably responsive to said selected output signal in a manner to allow for a cathode to anode current flow to present said switch in said alarm circuit.

7. The device as claimed in claim 4, wherein said circuitry includes means for modifying said output signal corresponding to a level of creosote buildup whereby to adjust said creosote deposit level at which said trigger means operably responds.

8. The device as claimed in claims 4 or 7, wherein said output signal is an electrical resistance developed across said plates.

9. The device as claimed in claim 8, wherein said trigger means is a silicon unilateral switch operably responsive to a critical resistance presented thereto in a manner to allow for a current flow through said silicon unilateral switch and actuation of said alarm circuit.

10. The device as claimed in claim 1, wherein said alarm circuit comprises:

a flag member;

a mounting plate for positioning said flag member to the exterior of said chimney;

a biased pivot arm mounted to said mounting plate in swinging movement thereto with said flag member mounted to said pivot arm;

locking means for maintaining said pivot arm at a first position during said off mode of said alarm circuit, said locking means releasing said pivot arm upon actuation of said alarm circuit with said biased pivot arm swinging to a position indicative of said accrual of a selected level of creosote buildup.

11. A material monitoring device for ascertaining the level of material buildup on a selected surface comprising:

a collector probe for receiving a material deposit thereon, said probe including means therein for producing an output signal indicative of the amount of said material deposit;

an alarm circuit having an off mode and an on mode indicative of the accrual of a selected level of material deposit on said collector probe; and a trigger device for said alarm circuit, said trigger device operably responsive to a selected output signal whereby to place said alarm circuit into said on mode.

12. Apparatus for monitoring a material deposit on a selected surface comprising:

collection means for receiving a material deposit thereon corresponding to a like amount of deposit on said selected surface;

detection means for producing output data corresponding to the level of said material deposit;

alarm means having an on mode indicative of the accrual of a selected level of said material deposit; and trigger means operably responsive to said output data corresponding to said selected level of material deposit for actuating said alarm means into said on mode.

13. The apparatus as claimed in claim 11 wherein said signal producing means of said collector probe comprises:

first and second conductive plates with one of said plates lying adjacent said chimney flue, said creosote deposit variously bridging said conductive plates according to the level of creosote deposit on said chimney flue;

circuitry joining said probe to said trigger means and including said conductive plates, said creosote deposit bridging said conductive plates presenting a signal for processing by said circuitry and delivery of said processed signal to said trigger device; and said trigger device operably responsive to a selected signal processed by said circuitry whereby to place said claim circuit into said on mode.

14. The apparatus as claimed in claim 12 wherein said collection means comprises:

first and second conductive plates with one of said plates lying adjacent said chimney flue, said creosote deposit variously bridging said conductive plates according to the level of creosote deposit on said chimney flue;

circuitry joining said probe to said trigger means and including said conductive plates, said creosote deposit bridging said conductive plates presenting data for processing by said circuitry and delivery to said trigger means; and said trigger means operably responsive to selected data processed by said circuitry whereby to provide for actuation of said alarm means.

* * * * *

UNITED STATES PATENT AND TRADEMARK OFFICE

CERTIFICATE OF CORRECTION

PATENT NO. : 4,463,346

DATED : July 31, 1984

INVENTOR(S) : GORDON BATES

It is certified that error appears in the above—identified patent and that said Letters Patent is hereby corrected as shown below:

Column 1, line 29, insert --not-- after the word may.

Column 6, Claim 13, line 46, change "claim" to --alarm--.

Column 6, Claim 14, line 54, change "probe" to --plates--.

Signed and Sealed this

*Nineteenth* Day of *February 1985*

[SEAL]

*Attest:*

DONALD J. QUIGG

*Attesting Officer* *Acting Commissioner of Patents and Trademarks*